US012332021B2

(12) United States Patent
Teetzel et al.

(10) Patent No.: US 12,332,021 B2
(45) Date of Patent: Jun. 17, 2025

(54) SCOPE MOUNT SYSTEM WITH OFFSET ACCESSORY ATTACHMENT MOUNT

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 48 days.

(21) Appl. No.: 18/241,455

(22) Filed: Sep. 1, 2023

(65) Prior Publication Data

US 2024/0077284 A1 Mar. 7, 2024

Related U.S. Application Data

(60) Provisional application No. 63/403,395, filed on Sep. 2, 2022.

(51) Int. Cl.
*F41G 11/00* (2006.01)
*F41G 1/54* (2006.01)

(52) U.S. Cl.
CPC ..... *F41G 11/003* (2013.01); *F41G 1/545* (2013.01)

(58) Field of Classification Search
CPC ..... F41G 11/003; F41G 1/545
See application file for complete search history.

(56) References Cited

U.S. PATENT DOCUMENTS 2,101,037 A * 12/1937 Charles ..... F41G 11/003 42/126
2,336,107 A * 12/1943 Litschert ..... F41G 11/002 42/126
3,724,800 A * 4/1973 Rubin ..... F41G 11/001 D22/110
4,397,107 A * 8/1983 Holden ..... F41G 11/006 42/126
5,433,010 A * 7/1995 Bell ..... F41G 11/003 42/122
5,787,630 A * 8/1998 Martel ..... F41G 11/003 42/127
6,705,037 B2 * 3/2004 Van Kirk ..... F41G 11/002 42/126
7,121,037 B2 * 10/2006 Penney ..... F41G 11/001 42/126
D632,753 S * 2/2011 Leighton ..... D22/109
(Continued)

*Primary Examiner* — Michelle Clement
(74) *Attorney, Agent, or Firm* — McLane Middleton, Professional Association

(57) ABSTRACT

A mount for attaching an optical scope to a weapon includes a base and front and rear lower clamping members extending from the base. The rear lower clamping member is axially spaced apart from the front lower clamping member. A front upper clamping member is attached to the front lower clamping member to define a front scope ring having a front cylindrical bore. A rear upper clamping member is attached to the rear lower clamping member to define a rear scope ring having a rear cylindrical bore, and wherein the front and rear cylindrical bores are co-aligned with a first axis. An accessory mount configured to receive a weapon accessory extends from the front upper clamping member and has an elongate portion extending along a second axis. The first axis and second axis are parallel and the second axis is laterally offset with respect to the first axis.

18 Claims, 11 Drawing Sheets

(56) References Cited

U.S. PATENT DOCUMENTS 8,347,544 B1 * 1/2013 Swan ..... F41G 1/38 42/124
8,353,125 B2 * 1/2013 Riley ..... F41G 11/003 248/315
8,683,732 B2 * 4/2014 Joplin ..... F41G 11/003 42/124
8,733,011 B2 * 5/2014 Spuhr ..... F41G 11/003 42/124
D713,921 S * 9/2014 Williams ..... D22/109
D715,393 S * 10/2014 Williams ..... D22/109
9,441,915 B2 * 9/2016 Zimmer ..... F41G 11/001
9,453,707 B2 * 9/2016 Williams ..... F41G 1/387
9,677,853 B2 * 6/2017 Haugen ..... F41G 11/005
9,759,524 B2 * 9/2017 Culp ..... F41G 11/003
10,041,765 B2 * 8/2018 McMakin ..... F41G 1/38
10,088,277 B2 * 10/2018 Zimmer ..... F41G 11/003
10,119,787 B2 * 11/2018 Geissele ..... F41G 11/003
10,359,258 B2 * 7/2019 Geissele ..... F41G 11/003
10,415,934 B2 * 9/2019 Babbitt ..... F16B 2/065
10,605,568 B2 * 3/2020 Curry ..... F41G 11/003
10,619,977 B2 * 4/2020 Silvennoinen ..... F41G 11/003
10,663,261 B2 * 5/2020 Summerfield ..... F41G 1/473
10,670,374 B2 * 6/2020 Storch ..... F41C 27/00
10,754,240 B2 * 8/2020 Peel ..... F41C 27/00
10,788,292 B2 * 9/2020 Alldredge ..... F41G 11/003
10,845,162 B2 * 11/2020 Geissele ..... F41G 11/003
10,935,347 B2 * 3/2021 Reis Green ..... F41G 1/38
11,293,721 B2 * 4/2022 Ding ..... F41G 1/44
11,435,163 B2 * 9/2022 Roberson ..... F41G 11/003
11,543,212 B1 * 1/2023 Letts ..... F41G 11/003
11,567,398 B2 * 1/2023 Peel ..... G03B 29/00
11,946,724 B2 * 4/2024 Gerber ..... F41G 11/003
11,971,242 B1 * 4/2024 Major ..... F41G 1/387
2009/0077855 A1 * 3/2009 Pritchett ..... F41G 11/003 42/90
2015/0241174 A1 * 8/2015 Silvennoinen ..... F41G 11/003 248/223.41
2018/0306554 A1 * 10/2018 Patton ..... F41G 1/545
2020/0232765 A1 * 7/2020 Patton ..... F41G 1/545
2021/0333068 A1 * 10/2021 Lindsay ..... F41G 11/003
2023/0221096 A1 * 7/2023 Ding ..... G08B 5/36 42/126
2024/0093967 A1 * 3/2024 Karagias ..... F41G 11/001
2024/0337467 A1 * 10/2024 Miller ..... F41G 11/003
2024/0345466 A1 * 10/2024 Peel ..... G03B 17/566

* cited by examiner

SCOPE MOUNT SYSTEM WITH OFFSET ACCESSORY ATTACHMENT MOUNT

CROSS REFERENCE TO RELATED APPLICATION

This application claims the priority benefit of U.S. provisional application Ser. No. 63/403,395 filed Sep. 2, 2022. The aforementioned application is incorporated herein by reference in its entirety.

BACKGROUND

The present invention relates generally to weapon scope mounts and, more particularly, to a weapon scope mount system having an accessory mount allowing an additional accessory device to be attached to the weapon when a weapon scope is mounted to the weapon.

It is well known to use various accessories such as illuminators, laser pointers, range finders, and the like, mounted on weapons, such as firearms, for example, rifles. Such accessories may have various applications, including military, law enforcement, security, and others. Commonly, weapon operators also find it advantageous to mount an optical scope on the weapon. Many optical scopes have one or more adjustment knobs or turrets which protrude from the main tube of the scope, e.g., elevation, windage, and parallax adjustment turrets. For example, a weapon scope commonly has an elevation adjustment turret disposed on top of the scope which can block the view of an auxiliary accessory device attached to the weapon at a position forward of the scope. The present disclosure contemplates a new scope mount system with accessory mounting surface which overcomes the above-referenced problems and others.

SUMMARY

In one aspect, the present disclosure provides a mount for attaching an optical scope to a weapon. The mount comprises a base having a lower surface that faces the weapon when the base is mounted on the weapon and an upper surface opposite the lower surface. A front lower clamping member extends from the base and a rear lower clamping member extends from the base, wherein the front and rear lower clamping members are axially spaced apart. A front upper clamping member is releasably attached to the front lower clamping member, wherein the front upper clamping member and the front lower clamping member cooperate to define a front scope ring having a front cylindrical bore. A rear upper clamping member is releasably attached to the rear lower clamping member, wherein the rear upper clamping member and the rear lower clamping member cooperate to define a rear scope ring having a rear cylindrical bore, and wherein the front and rear cylindrical bores are aligned with a first axis. An accessory mount extends from the front upper clamping member, the accessory mount having an elongate portion configured to receive a weapon accessory. The elongate portion extends along a second axis, wherein the first axis and second axis are parallel axes, and wherein the second axis is laterally offset with respect to the first axis.

Further aspects, advantages, and benefits of the present disclosure will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention, and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

The term "substantially" means that the recited characteristic, parameter, or value need not be achieved exactly, but that deviations or variations, including for example, tolerances, measurement error, measurement accuracy limitations, and other factors known to those of skill in the art, may occur in amounts that do not preclude the effect the characteristic was intended to provide.

The terms first, second, etc., may be used herein to describe various elements. These elements should not be limited by these terms, as these terms are only used to distinguish one element from another unless stated otherwise or the context clearly indicates otherwise.

Figure 1:
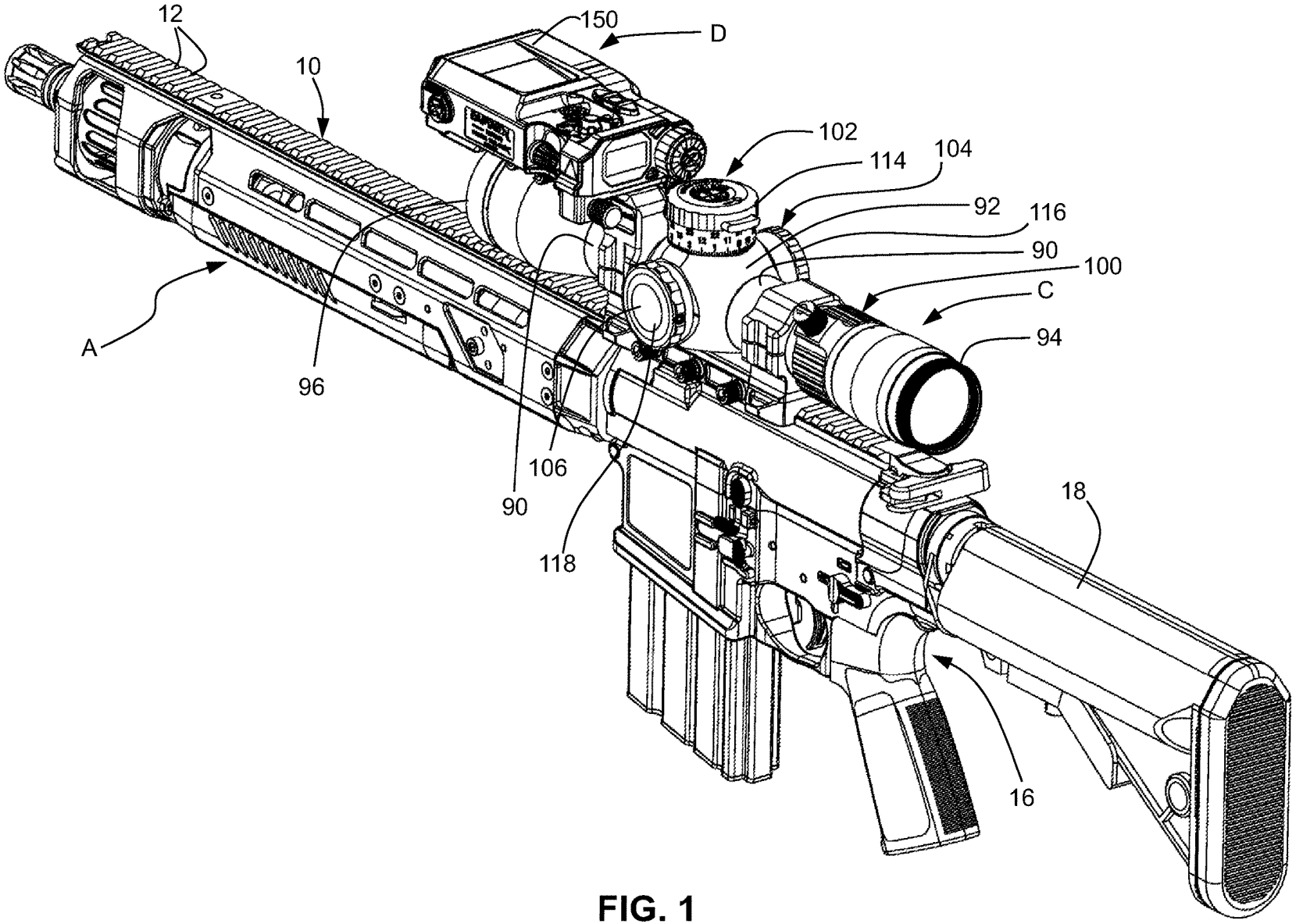
FIG. 1 is an isometric view of a weapon having a scope mount with a scope and an additional weapon accessory device mounted thereto, according to a first exemplary embodiment of the present disclosure.
Figure 2:
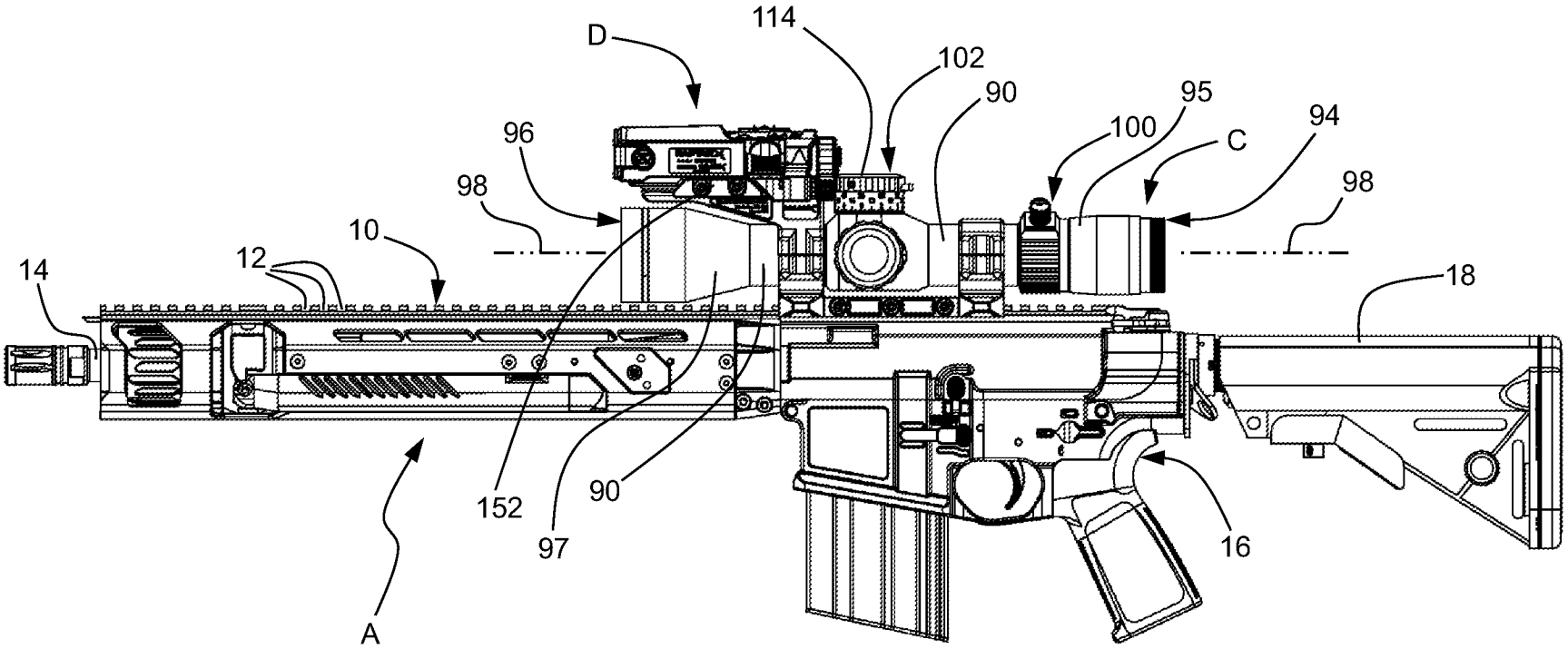
FIG. 2 is a side elevational view of the weapon having the scope mount with the scope and the additional weapon accessory device attached appearing in FIG. 1.
Figure 3:
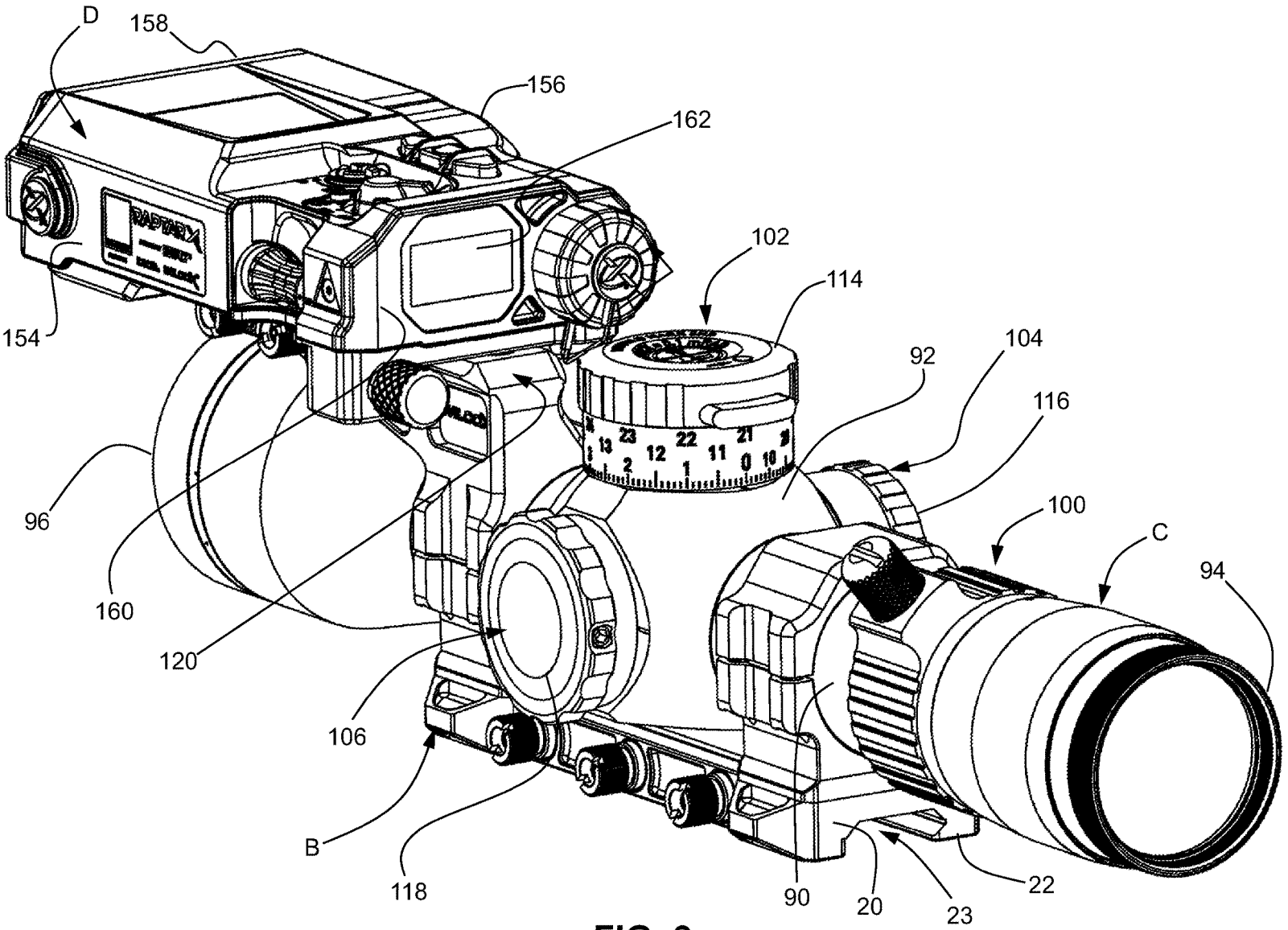
FIG. 3 is an enlarged isometric view of the scope mount embodiment of FIG. 1, with the scope and additional weapon accessory device attached.
Figure 4:
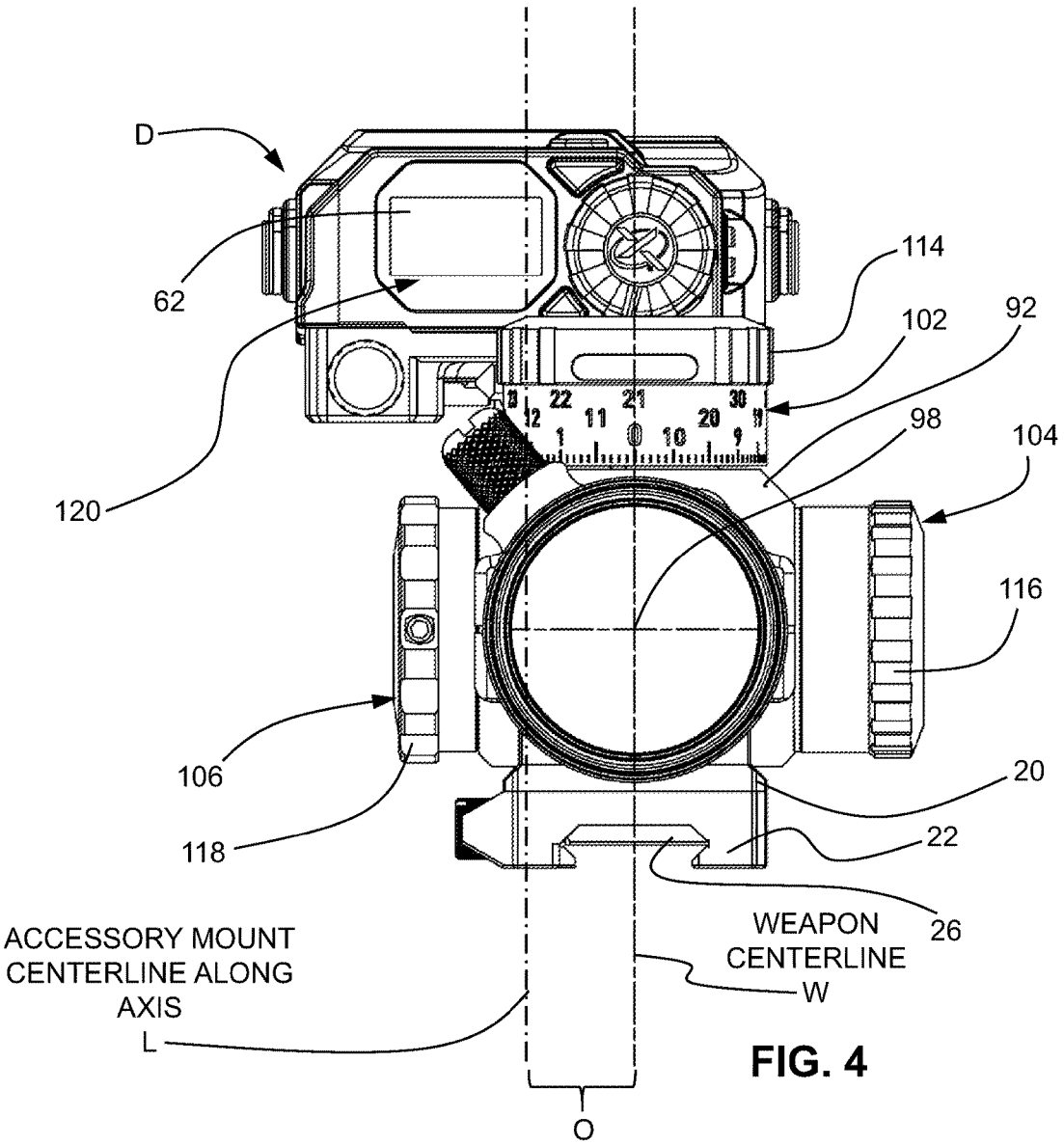
FIG. 4 is a rear elevational view of the scope mount appearing in FIG. 3, with the scope and the additional weapon accessory device attached.
Figure 5:
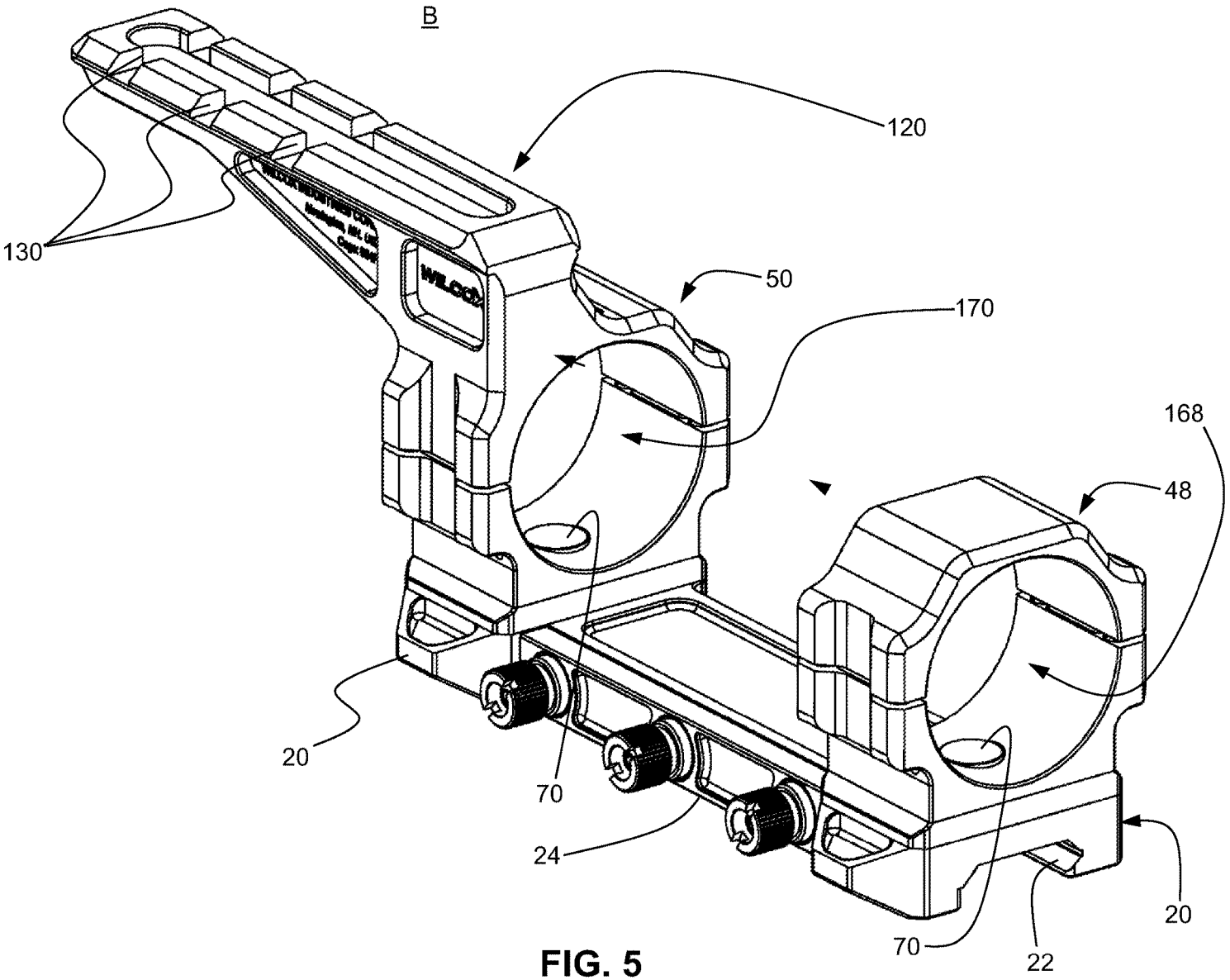
FIG. 5 is an isometric view of the scope mount appearing in FIG. 3, with the scope and the additional weapon accessory device removed.
Figure 6:
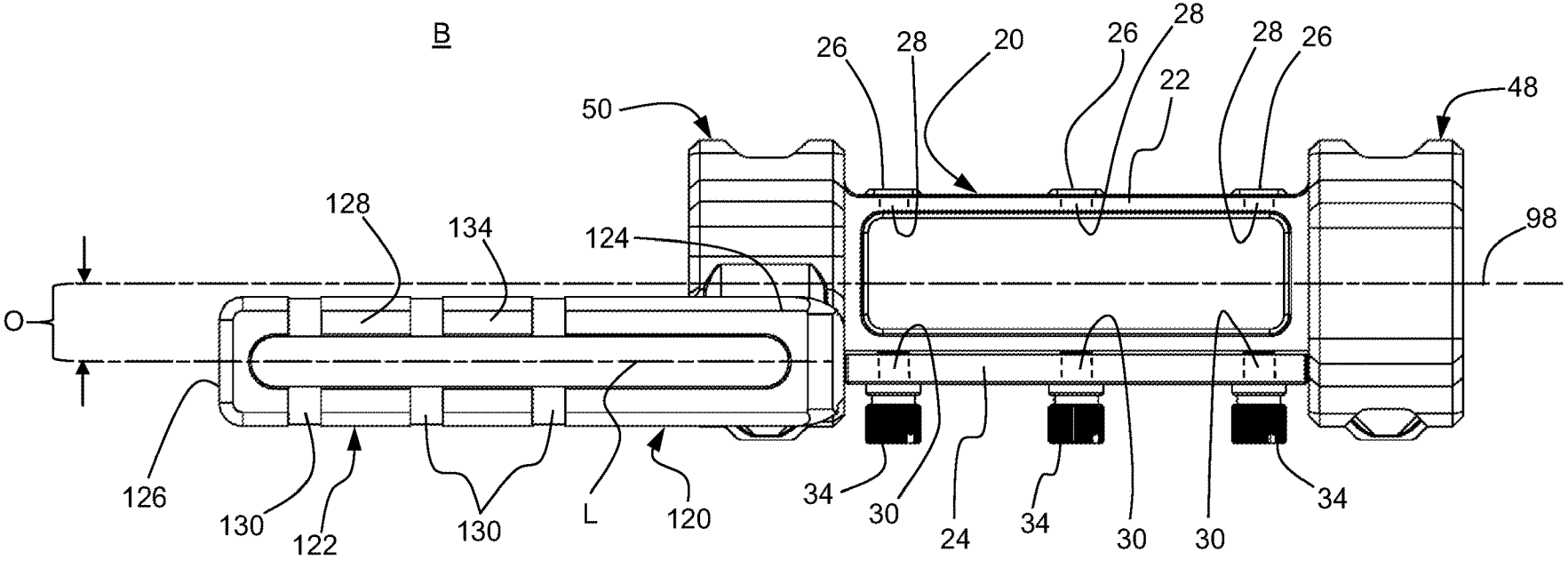
FIG. 6 is a top plan view of the scope mount appearing in FIG. 5.
Figure 7:
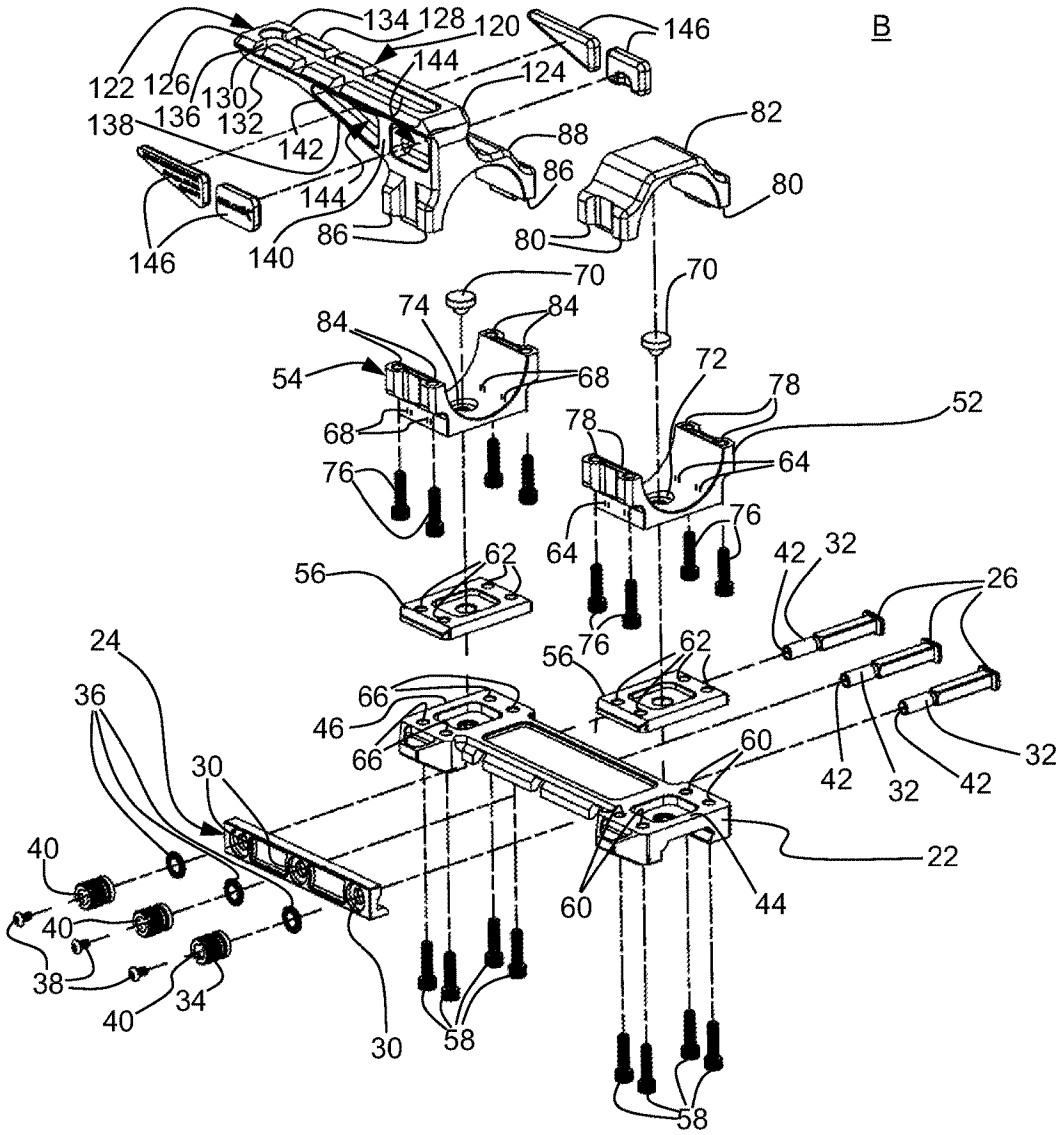
FIG. 7 is an exploded isometric view of the scope mount appearing in FIG. 5.

Referring now to the drawing figures, where like reference numerals are used to describe like or analogous items, FIGS. 1 and 2 illustrate an exemplary embodiment weapon A having a scope mount assembly B. In the depicted embodiment, a scope C and an auxiliary weapon accessory device D are mounted to the scope mount assembly B.

The weapon A may be a firearm such as a military or tactical rifle having an accessory rail interface 10. In embodiments, the accessory rail interface 10 is a Picatinny rail interface. As used herein, the term Picatinny rail interface refers to a bracket used on some firearms in order to provide a standardized mounting platform. Typically, Picatinny rail interfaces have a beveled T-shaped cross-sectional shape and having a series of alternating transverse grooves 12. Exemplary Picatinny rail interfaces include MIL-STD-1913 accessory rails or STANAG 2324 accessory rails, which are well known by persons skilled in the art.

The illustrated weapon A further includes a barrel 14, receiver 16, and stock 18. It will be recognized, however, that the present invention may be adapted for use with all manner of weapons, including without limitation rifles, shotguns, handguns, machine guns, grenade launchers, mortars, etc., and all manner of weapon accessory mount rail interfaces or mounting systems.

Referring now to FIGS. 3-9, and with continued reference to FIGS. 1 and 2, the scope mount assembly B includes a base member 20. The lower surface of the base member 20 includes one or more fixed clamping members 22, which extend axially and engage a right side of the accessory rail 10. A movable clamping member 24 is disposed opposite the fixed clamping member 22 and extends axially along a left side of the accessory rail 10. The clamping member 24 and the clamping member 22 define a channel 23 therebetween. The movable rail clamp member 24 is selectively movable toward and away from the fixed member 22 for releasably attaching the scope mount assembly B to the accessory mounting rail 10.

Drawbars 26 pass through corresponding clearance openings 28 in the fixed clamping member 22. The drawbars 26 are configured and axially spaced a distance apart to align with and pass through the transverse recoil grooves 12 in the rail interface 10 when the mount is attached to the weapon A. The distal ends of the drawbars 26 pass through corresponding clearance openings 30 in the movable clamping member 24.

The drawbars 26 have threaded ends 32 which engage internally threaded nuts 34. Lock washers 36, e.g., serrated or ribbed lock washers, are disposed intermediate the nuts 34 and the surface of the movable clamping member 24 to prevent inadvertent loosening. Nut retaining screws 38 pass through corresponding clearance openings 40 in the nuts 34 and engage tapped openings 42 in the distal ends of the drawbars 26 to prevent disengagement of the nuts 34 from the drawbars 26.

The scope mount base 20 includes a rear mounting surface 44 and a front mounting surface 46. It will be recognized that in the illustrated embodiment, the mount base 20 is ambidextrous, i.e., it can be rotated 180 degrees, so that the user can choose which side of the mount the shock nuts 34 are on depending how it is assembled. A rear scope ring 48 is releasably secured to the rear mounting surface 44. A front scope ring 50 is releasably secured to the front mounting surface 46. A rear lower scope cradle 52 defines a bottom half of the rear scope ring 48. A front lower scope cradle 54 defines a bottom half of the front scope ring 50. In certain embodiments, one or more shims 56 are disposed intermediate the rear mounting surface 44 and the downward facing surface of the rear lower scope cradle 52, and, intermediate the front mounting surface 46 and the downward facing surface of the front lower scope cradle 54.

In certain embodiments, the shims 56 are formed of a polymer, e.g., injection molded, material. Preferably, the shims 56 are formed of an elastomeric material, such as a synthetic or natural elastomeric or rubber material which provides shock or vibration isolation, dampening, and/or absorption between the weapon A and the attached scope C and accessory device D. Exemplary elastomeric materials which may be used in making the coupling member include, for example, polyurethane, polyisoprene, polybutadiene, neoprene, butadiene-acrylonitrile copolymers, ethylene-butadiene block copolymers, ethylene-propylene based copolymers, natural rubber, polychloroprene rubber, polyisoprene-isobutylene copolymers, silicone rubber, styrene-acrylonitrile copolymers, styrene-butadiene copolymers, styrene-isoprene copolymers, styrene-maleic anhydride copolymers, fluoroelastomers, polyolefins, and so forth. This list is intended to be illustrative rather than limiting. The shims 56 may be manufactured from a suitable conventional elastomeric material in a conventional manner, such as by extrusion, molding, machining from suitable stock material, or the like.

A plurality of fasteners 58 pass through clearance openings 60 in the rear mounting surface 44. In certain embodiments, the fasteners 58 pass upwardly from the bottom. The fasteners 58 also pass through aligned clearance openings 62 in the one or more shims 56 and engage tapped openings 64 in the lower surface of the rear lower scope cradle 52. In embodiments, the tapped openings 64 are blind openings.

A plurality of fasteners 58 also pass through clearance openings 66 in the front mounting surface 46. In preferred embodiments, the fasteners 58 pass upwardly from the bottom. The fasteners 58 also pass through aligned clearance openings 62 in the one or more shims 56 and engage tapped openings 68 in the lower surface of the front lower scope cradle 54. In embodiments, the tapped openings 68 are blind openings.

Grommets 70 formed of rubber or other elastomeric polymer are received within receptacles, such as openings or cavities, 72, 74 disposed at the bottom of the rear and front scope cradles, respectively, to increase friction between a tubular housing 90 of the scope C and the scope clamping rings 48, 50.

A plurality of upper cradle fasteners 76 pass through clearance openings 78 in the rear lower scope cradle 52. In certain embodiments, the fasteners 58 pass upwardly from the bottom. The fasteners 76 engage tapped openings 80 in the lower surface of a rear upper scope cradle 82. The rear lower scope cradle 52 and the rear upper scope cradle 82 cooperate to define the rear scope ring 48. In embodiments, the tapped openings 80 are blind openings.

Another plurality of upper cradle fasteners 76 pass through clearance openings 84 in the front lower scope cradle 54. In certain embodiments, the fasteners 76 pass upwardly from the bottom. The fasteners 76 engage tapped openings 86 in the lower surface of a front upper scope cradle 88. The front lower scope cradle 54 and the front upper scope cradle 88 cooperate to define the front scope ring 50. In embodiments, the tapped openings 86 are blind openings.

The rear lower scope cradle 52 includes a tongue portion 73 extending downwardly from each side edge of the rear lower scope cradle 52. A correspondingly configured groove portion 75 is formed in the opposing side edges of the rear upper scope cradle 82, whereby each tongue 73 can be received in the respective groove 75 for interlocking and properly aligning the rear lower scope cradle 52 and the rear upper scope cradle 82 together to form the rear scope ring 48. Preferably, the tongues 73 and grooves 75 are sized to form a relatively tight fit when the tongues 73 are inserted into the grooves 75. In the illustrated embodiment, the tongues 73 and grooves 75 extend in a direction parallel to the optical axis 98.

The front lower scope cradle 54 includes a tongue portion 83 extending downwardly from each side edge of the front lower scope cradle 54. A correspondingly configured groove portion 85 is formed in the opposing side edges of the front upper scope cradle 88, whereby each tongue 83 can be received in the respective groove 85 for interlocking and properly aligning the front lower scope cradle 54 and the front upper scope cradle 88 together to form the front scope ring 50. Preferably, the tongues 83 and grooves 85 are sized to form a relatively tight fit when the tongues 83 are inserted into the grooves 85. In the illustrated embodiment, the tongues 83 and grooves 85 extend in a direction parallel to the optical axis 98.

The illustrated embodiment has been depicted with the tongue portions 73, 83 being disposed on the upper rear and front cradles 82 and 88, respectively, and the groove portions 75, 85 being disposed on the lower rear and front cradles 52 and 54, respectively. However, it alternative embodiments, the tongue and groove portions may be reversed such that the tongue portions extend upwardly from the side edges of the lower rear and front cradles 52 and 54 and the correspondingly configured groove portions may be formed in the side edges of the upper rear and front cradles 82 and 88.

In the illustrated embodiments, the cradle fasteners that secure the scope are installed up from the bottom. This provides a smooth profile on the upper surfaces of the scope rings 48, 50 and avoids protruding fastener heads or holes on the upper surfaces of the scope rings 48, 50. In addition, orienting the fasteners so that they are installed up from the bottom provides access to the cradle fasteners when an accessory devices is attached to the upper mounting surface.

The optical scope C is representative of the types of optical scope with which the scope mount assembly B of the present invention may be used. For example, in certain embodiments, the optical scope C is a LEUPOLD® rifle scope available from Leupold & Stevens, Inc., of Beaverton, OR. It will be recognized that other optical scopes can be employed, as would be understood by persons skilled in the art.

The optical scope C comprises a tubular housing 90 and a turret junction 92. The scope tubular housing 90 includes a first end 94 defining an eye bell with an ocular lens and a second end 96 defining an objective bell with an objective lens, the eye bell and objective bell having tapered housings 95, 97, respectively, to accommodate diverging and converging light rays passing therethrough. The scope tubular housing 90 further defines a scope optical axis 98. In the illustrated embodiment, the scope optical axis 98 is laterally or transversely aligned with a centerline W of the weapon A. The optical scope C further comprises a first adjustment assembly 100, a second adjustment assembly 102, a third adjustment assembly 104, and a fourth adjustment assembly 106.

In embodiments, the first adjustment assembly 100 comprises a magnification adjustment ring 108 supported by the scope tubular housing 90. The magnification adjustment ring 108 is arranged between the first end 94 of the scope tube 40 and the turret junction 92. The magnification adjustment ring 108 is supported by the scope tubular housing 90 such that it is manually rotatable about the scope axis 98 relative to the scope tubular housing 90, wherein rotation of the magnification adjustment ring 108 in relation to the scope tubular housing 90 provides an adjustment of the optical magnification or zoom level of the optical scope C. In the illustrated embodiment, the magnification adjustment ring 108 includes a mounting surface 110 having a magnification adjustment throw lever 112 attached thereto.

The second adjustment assembly 102 comprises a first adjustment turret 114 which extends upwardly from the turret junction 92. In embodiments, first adjustment turret 114 is manually rotatable to adjust the optical scope C for elevation. The third adjustment assembly 104 comprises a second adjustment turret 116 which extends laterally from the turret junction 92. In embodiments, second adjustment turret 116 is manually rotatable to adjust the optical scope C for windage. The fourth adjustment assembly 106 comprises a third adjustment turret 118 which extends laterally from the turret junction 92 opposite the third adjustment assembly 104. In embodiments, third adjustment turret 118 is manually rotatable to adjust the optical scope C for parallax or target focus.

An accessory mount 120 is attached to the front upper scope cradle 82. In embodiments, the accessory mount 120 is integrally formed, i.e., monolithically formed, with the front upper scope cradle 82. The accessory mount 120 includes a mounting platform 122 having a proximal end 124 affixed to the front upper scope cradle 82 and a free distal end 126 opposite the proximal end 124. The accessory mounting platform 122 sits above the objective bell 96 of the associated optical scope C and is cantilevered away from the front upper scope cradle 82. The mounting platform 122 has an upper mounting surface 128. One or more transversely extending grooves or channels 130 are formed in the upper mounting surface 128. The mounting platform 122 has a lower mounting surface 132 opposite the upper mounting surface 128. In embodiments, the upper mounting surface 128 has axially extending beveled edges 134. In embodiments, the lower mounting surface 132 has axially extending beveled edges 136. In preferred embodiments, the mounting platform 122 defines a Picatinny rail interface.

In the illustrated embodiment, the accessory mount 120 further includes a buttress 138 having a proximal end 140 and a distal end 142 opposite the proximal end 140. The proximal end 140 is affixed to the front upper scope cradle 82 and the distal end 142 is affixed to the lower mounding surface 132. In embodiments, one or more apertures 144 are formed in the accessory mount 120, e.g., to reduce the weight of the scope mount assembly B. In embodiments, placard inserts 146 are provided for insertion into the apertures 144. In embodiments, the placard inserts 146 are retained in the apertures 144 via a friction fit, snap fit, press fit, interference fit, adhesive, or other fastener. The inserts 146 may be formed of a molded, e.g., injection molded, polymer material and may contain, for example, branding information or other informational or decorative indicia.

Figure 10:
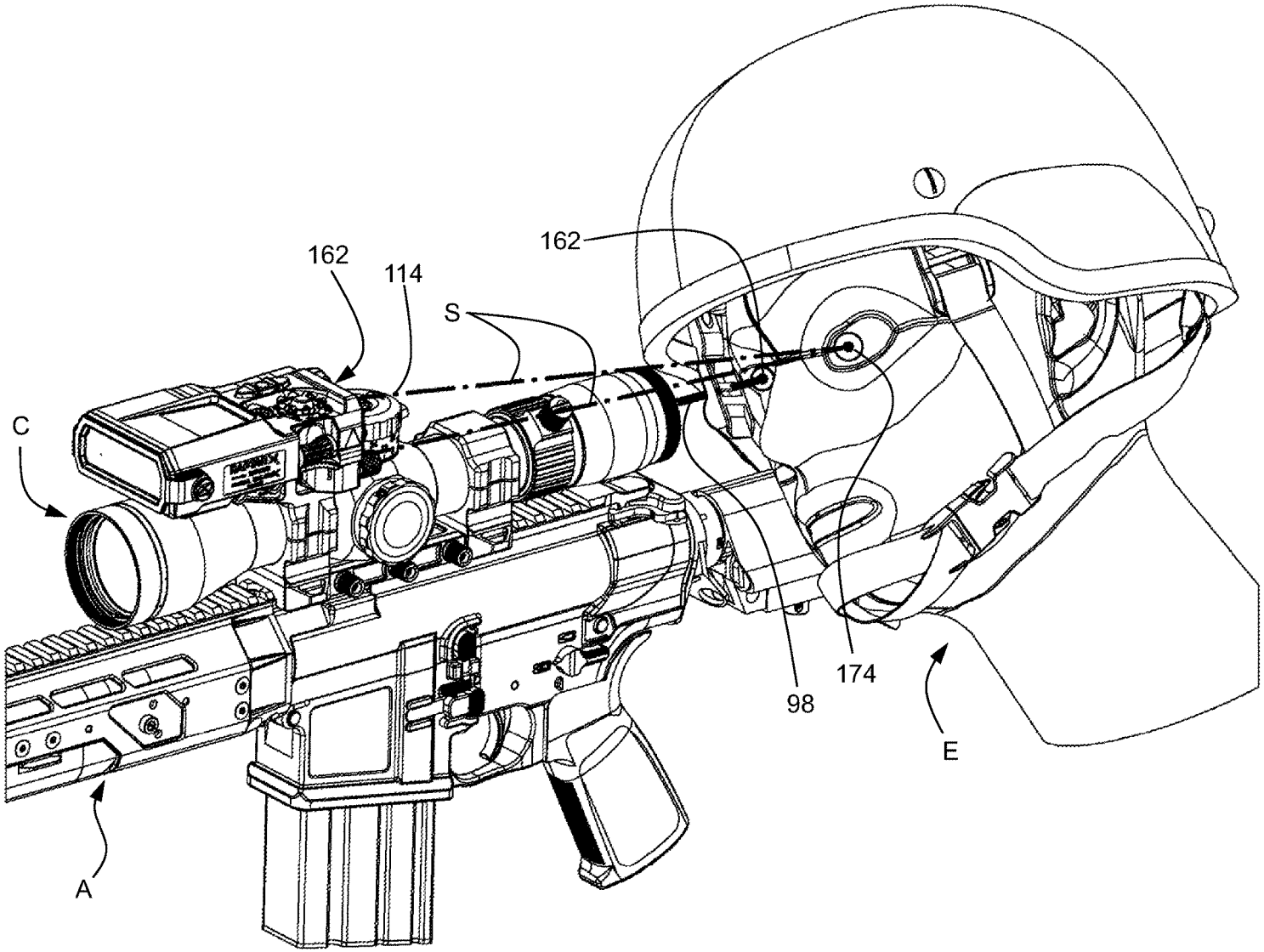
FIG. 10 is an isometric view of the scope mount embodiment of FIG. 1, with an operator having eye sighting along an optical axis of the scope and another eye viewing a rearward facing display on the additional weapon accessory device.
Figure 11:
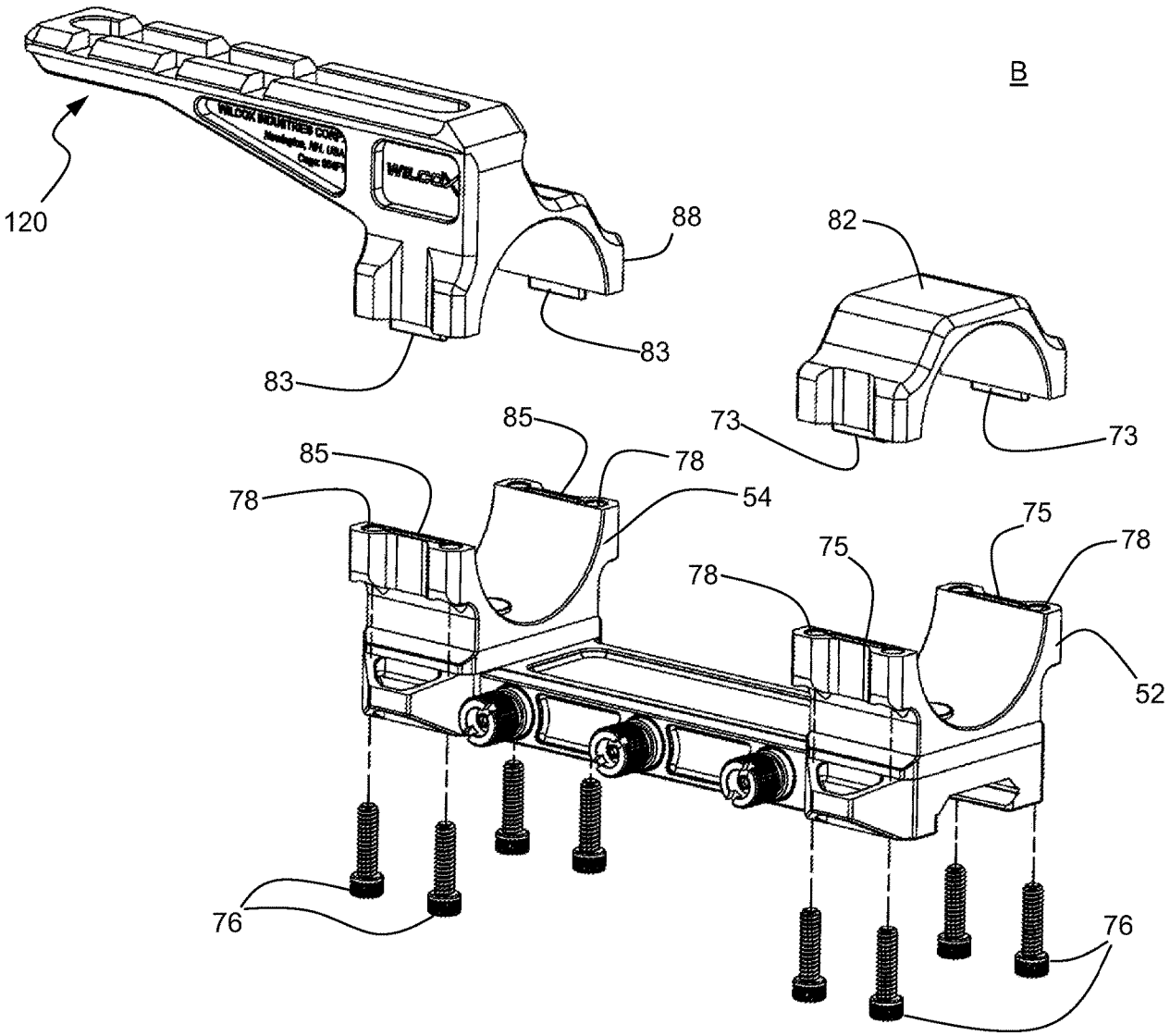
FIG. 11 is an enlarged, partially exploded view of the scope mount appearing in FIG. 5.

The accessory device D may be a laser aiming and/or illuminating device, optical range finder, ballistics computation device, auxiliary sighting system, fire control system, camera system, weapon video display, among others. In embodiments, the accessory device D is a device having a display or other viewable indicia. The scope mounting assembly B is particularly advantageous for use in connection with an accessory device D which has a human-viewable display on the back of the device that the shooter E would want to look at while at the same time looking through the scope C. For example, the embodiment appearing in FIG. 10 illustrates the shooter E viewing along the optical axis 98 of the scope C with a right eye 172. The lateral offset of the upper mounting surface 128 toward the shooter's left eye 174 laterally displaces device D with respect to the upstanding scope turret 114 to allow viewing the display 162 along sight lines S with the shooter's left eye 174. It will be recognized that lateral offset of the upper mounting surface 128 with respect to the scope mounting assembly B may be reversed to accommodate left handed shooters.

The accessory device D includes a housing 150 defining an enclosure or shell containing the internal components of the accessory device D. A rail clamp assembly 152 is provided on the device D for releasably attaching the unit D to the accessory mount 120. The accessory device D generally defines a footprint having a lateral extent defined by the left and right sides 154, 156, respectively, of the unit D and an axial extent defined by the front and rear sides 158, 160, respectively, of the unit D.

The rear surface 160 of the device D includes a display 162 for outputting information, such as range information or other indicia, in human viewable form. It has been found that the second adjustment assembly 102, e.g., the elevation adjustment 114, which protrudes upward from the turret junction 92 obstructs the view of the display when the operator's eye is aligned with the scope optical axis 98. In preferred embodiments, to overcome this problem, the proximal end 124 of the mounting platform 122 is attached to the front upper scope cradle 88 at a point along an axis L, which is laterally offset by a distance O from the scope optical axis 98 and the weapon centerline 88. In embodiments, the distance O is about 0.5 inches (1.27 cm), although other offset distances are contemplated. In this manner, the display 162 disposed on the rear housing surface 160 of the accessory device D can be visualized by the operator without obstruction by the protruding turret 114.

Figure 8:
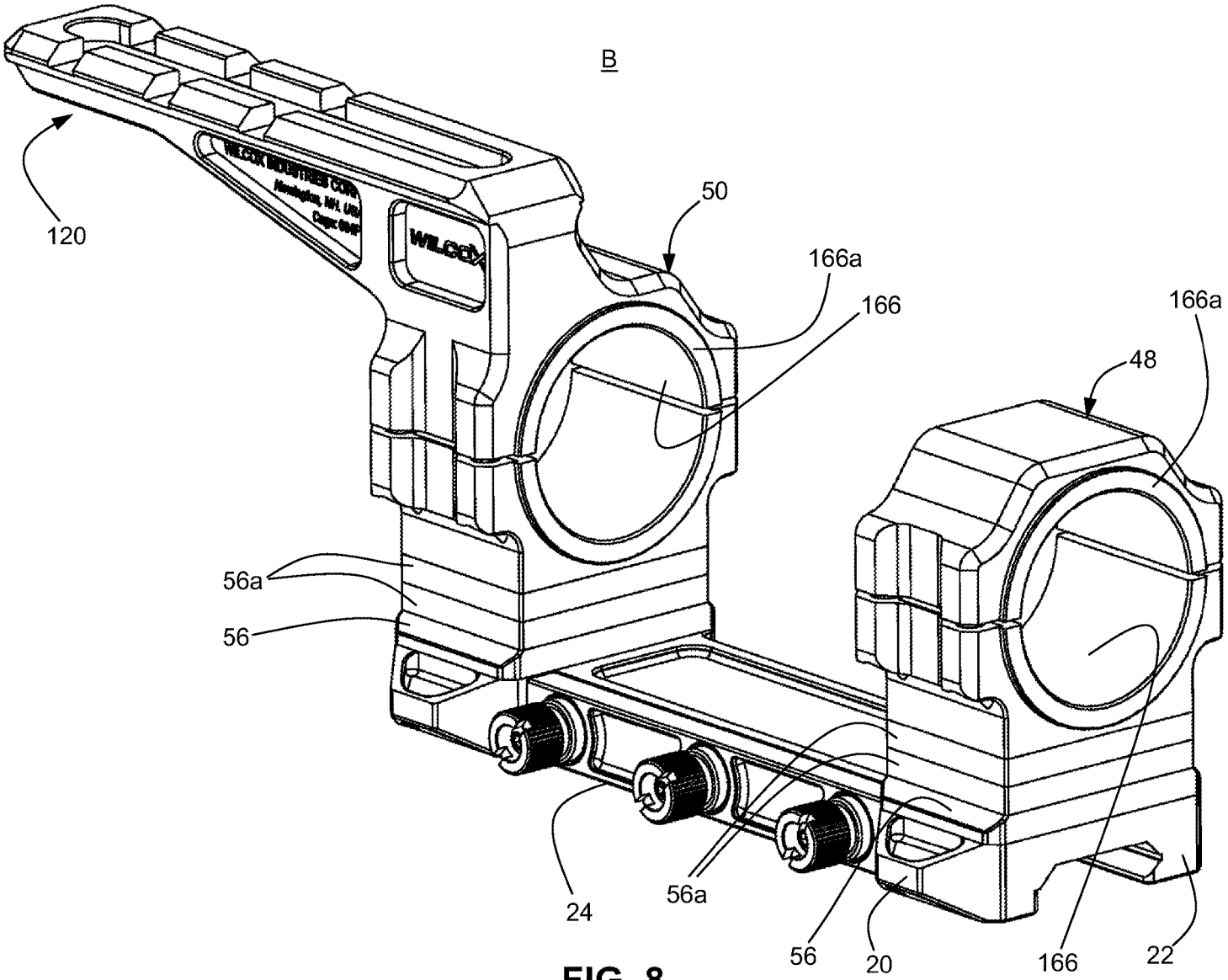
FIG. 8 is an isometric view of the scope mount appearing in FIG. 5, with radius-reducing shims to configure the mount for use with an optical scope having a smaller diameter scope tube and height adjustment shims for increasing the elevation of the scope above the weapon.
Figure 9:
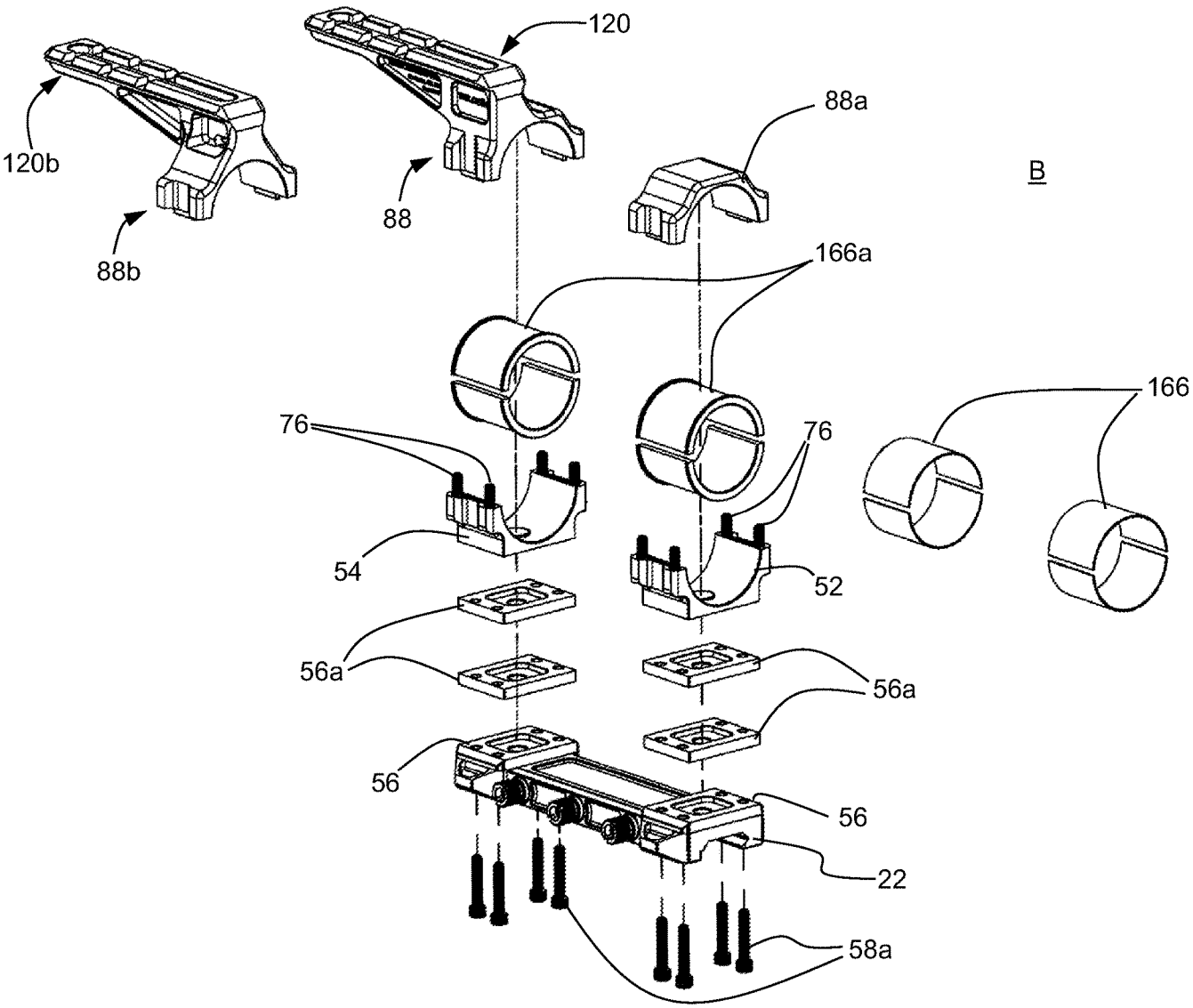
FIG. 9 is a partially exploded isometric view of the scope mount appearing in FIG. 8, showing the optional height adjustment shims and the interchangeable pairs of radius-reducing shims having different thicknesses.

As best seen in FIGS. 8 and 9, there is shown the scope mount assembly B is readily adaptable for use with scopes with larger objective lenses 96 and/or smaller diameter scope tubular housings 90. Although the embodiment appearing in FIGS. 8 and 9 illustrate a configuration employing both the height adjustment shims and radius-reducing shims, it will be recognized that the assembly B can be utilized with the height adjustment shims without the radius-reducing shims or vice versa.

To raise the height of the scope C above the weapon, e.g., to accommodate a scope C having a larger objective lens 96, one or more shims **56*a* are placed between the shim 56 and the rear lower scope cradle 52. To ensure the bore defined by the front scope ring 50 is coaxial with the bore defined by the rear scope ring 48, a corresponding number of shims 56*a* are also placed intermediate the shim 56 and the front lower scope cradle 54. The fasteners 58 as described above may need to be replaced with longer fasteners 58*a* when using the additional height adjustment shims 56*a*. The shims 56*a* may be formed of the materials as the shims 56** described above and provide a shock or vibration absorbing, dampening, or isolating function.

Split radius-reducing shims 166 are disposed within the axial passageway 168 defined by the rear scope ring 48 and the axial passage way 170 defined by the front scope ring 50 if it is desired to reduce the diameter of the scope rings to a first reduced diameter dimension. The diameter dimension of the passageways 168, 170 will be reduced 2 times the shim thickness. In certain embodiments, the diameter of the axial passageways 168 and 170 is 35 mm. In certain embodiments, the thickness of the radius-reducing shims 166 is 0.5 mm to thereby reduce the diameter of the axial passageways 168 and 170 from 35 mm to 34 mm. In certain embodiments, the radius-reducing shims 166 are formed of 90 durometer self-adhering polyurethane.

Alternately, split radius-reducing shims **166*a* are disposed within the axial passageway 168 defined by the rear scope ring 48 and the axial passage way 170 defined by the front scope ring 50 if it is desired to reduce the diameter of the scope rings to a second reduced diameter dimension. The diameter dimension of the passageways 168, 170 will be reduced 2 times the shim thickness. In certain embodiments, the thickness of the radius-reducing shims 166*a* is 2.5 mm to thereby reduce the diameter of the axial passageways 168 and 170 from 35 mm to 30 mm. In certain embodiments, the radius-reducing shims 166*a*** are formed of metal or a stable polymer. It will be recognized that split radius-reducing shims having other thicknesses to accommodate other scope housing tube diameters are also contemplated.

In certain embodiments, the scope mount assembly B may comprise a kit of components usable together including a plurality of sets of differently sized scope ring diameter-reducing shims and/or a plurality of height-adjustment shims. In certain embodiments, the scope mount assembly B may comprise a kit of components usable together including a plurality of interchangeable upper front scope cradles having different configurations. For example, an upper front scope cradle **88*a* may be provided for use in place of the upper front scope cradle 88 when it is not desired to utilize a secondary accessory device D in conjunction with the scope C. The upper front scope cradle 88*a* is as described above by way of reference to the upper front scope cradle 88, except that it lacks the accessory mount 120. Alternatively, in certain embodiments, an upper front scope cradle 88*b* may be provided for use in place of the upper front scope cradle 88 when it is desired to laterally align a secondary accessory device D with the scope optical axis 98 and weapon centerline W. The upper front scope cradle 88*b* is as described above by way of reference to the upper front scope cradle 88, except that it includes an accessory mount 120*b* which is as described above by way of reference to the accessory mount 120 except that the accessory mount 120*b* lacks the lateral offset O such that the accessory mount 120 is centered on the upper front scope cradle 88*b* and the accessory mount 120*b* is in lateral alignment with the scope optical axis 98** and weapon centerline W.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A mount for attaching an optical scope to a weapon, the mount comprising:

a base comprising a lower surface that faces the weapon when the base is mounted on the weapon and an upper surface opposite the lower surface;

a front lower clamping member extending from the base;

a rear lower clamping member extending from the base, wherein the rear lower clamping member is axially spaced apart from the front lower clamping member;

a front upper clamping member releasably attached to the front lower clamping member, wherein the front upper clamping member and the front lower clamping member cooperate to define a front scope ring having a front cylindrical bore;

a rear upper clamping member releasably attached to the rear lower clamping member, wherein the rear upper clamping member and the rear lower clamping member cooperate to define a rear scope ring having a rear cylindrical bore, and wherein the front and rear cylindrical bores are co-aligned with a first axis; and an accessory mount extending from and integral with the front upper clamping member, the accessory mount having an elongate portion extending along a second axis, the accessory mount configured to receive a weapon accessory, wherein the first axis and second axis are parallel, and further wherein the second axis is laterally offset with respect to the first axis.

2. The mount of claim 1, wherein the accessory mount is cantilevered away from the front upper clamping member.

3. The mount of claim 2, further comprising a buttress having a proximal end and a distal end opposite the proximal end, wherein the proximal end is affixed to the front upper clamping member and the distal end is affixed to a lower surface of the accessory mount.

4. The mount of claim 1, further comprising:

at least a first height adjustment shim disposed between the upper surface of the base and the front lower clamping member; and at least a second height adjustment shim disposed between the upper surface of the base and the rear lower clamping member.

5. The mount of claim 4, wherein the at least a first height adjustment shim and the at least a second height adjustment shim are formed of an elastomeric material.

6. The mount of claim 1, further comprising:

one or more front radius-reducing members configured for attachment to an inner surface of the front scope ring within the front cylindrical bore, the one or more front radius-reducing members having a preselected thickness, wherein the one or more front radius-reducing members are configured to reduce a diameter dimension of the front cylindrical bore; and one or more rear radius-reducing members configured for attachment to an inner surface of the rear scope ring within the rear cylindrical bore, the one or more rear radius-reducing members having the preselected thickness, wherein the one or more rear radius-reducing members are configured to reduce a diameter dimension of the rear cylindrical bore.

7. The mount of claim 6, wherein the one or more front radius-reducing members and the one or more rear radius-reducing members are configured to reduce the diameter dimension of the front cylindrical bore and the rear cylindrical bore, respectively, from 35 mm to a reduced diameter selected from the group consisting of 34 mm and 30 mm.

8. The mount of claim 1, further comprising:

a first receptacle formed in a scope-engaging surface of the front scope ring;

a first grommet received within the first receptacle, the first grommet configured to increase friction between the front scope ring and the optical scope;

a second receptacle formed in a scope-engaging surface of the rear scope ring; and a second grommet received within the second receptacle, the second grommet configured to increase friction between the rear scope ring and the optical scope.

9. The mount of claim 1, further comprising:

a first plurality of threaded fasteners securing the base to the front lower clamping member;

a second plurality of threaded fasteners securing the base to the rear lower clamping member;

a third plurality of threaded fasteners securing the front lower clamping member to the front upper clamping member; and a fourth plurality of threaded fasteners securing the rear lower clamping member to the rear upper clamping member.

10. The mount of claim 9, further wherein:

each of the first plurality of threaded fasteners pass through an aligned clearance opening in the base and engage an aligned threaded opening in the front lower clamping member; and each of the second plurality of threaded fasteners pass through an aligned clearance opening in the base and engage an aligned threaded opening in the rear lower clamping member.

11. The mount of claim 10, further wherein the aligned threaded openings in the front lower clamping member and the aligned threaded openings in the rear lower clamping member are blind openings.

12. The mount of claim 9, further wherein:

each of the third plurality of threaded fasteners pass through an aligned clearance opening front lower clamping member and engage an aligned threaded opening in the front upper clamping member; and each of the fourth plurality of threaded fasteners pass through an aligned clearance opening rear lower clamping member and engage an aligned threaded opening in the rear upper clamping member.

13. The mount of claim 12, further wherein the aligned threaded openings in the front upper clamping member and the aligned threaded openings in the rear upper clamping member are blind openings.

14. The mount of claim 1, further comprising:

a first pair of tongue portions extending from opposing edges of the rear upper clamping member and removably engaging a first pair of correspondingly shaped grooves formed on opposing edges of the rear lower clamping member; and a second pair of tongue portions extending from opposing edges of the front upper clamping member and removably engaging a second pair of correspondingly shaped grooves formed on opposing edges of the front lower clamping member.

15. The mount of claim 1, wherein the mount is configured for attachment to a firearm.

16. The mount of claim 1, wherein the mount is configured for attachment to a rifle.

17. The mount of claim 1, wherein the accessory mount defines a Picatinny rail interface.

18. A kit of components usable together, comprising:

a mount for attaching an optical scope to a weapon, the mount comprising:

a base comprising a lower surface that faces the weapon when the base is mounted on the weapon and an upper surface opposite the lower surface;

a front lower clamping member extending from the base;

a rear lower clamping member extending from the base, wherein the rear lower clamping member is axially spaced apart from the front lower clamping member;

a front upper clamping member releasably attached to the front lower clamping member, wherein the front upper clamping member and the front lower clamping member cooperate to define a front scope ring having a front cylindrical bore;

a rear upper clamping member releasably attached to the rear lower clamping member, wherein the rear upper clamping member and the rear lower clamping member cooperate to define a rear scope ring having a rear cylindrical bore, and wherein the front and rear cylindrical bores are co-aligned with a first axis; and an accessory mount extending from and integral with the front upper clamping member, the accessory mount having an elongate portion extending along a second axis, the accessory mount configured to receive a weapon accessory, wherein the first axis and second axis are parallel, and further wherein the second axis is laterally offset with respect to the first axis; and at least one of:

a set of height adjustment shims; and a set of radius-reducing members;

wherein the set of height adjustment shims includes one or more front height adjustment shims configured for removable installation between the upper surface of the base and the front lower clamping member and one or more rear height adjustment shims configured for removable installation between the upper surface of the base and the rear lower clamping member; and wherein the set of radius-reducing members includes one or more front radius-reducing members configured for attachment to an inner surface of the front scope ring within the front cylindrical bore, each of the one or more front radius-reducing members having a preselected thickness, wherein each of the one or more front radius-reducing members is configured to reduce a diameter dimension of the front cylindrical bore, and one or more rear radius-reducing member configured for attachment to an inner surface of the rear scope ring within the rear cylindrical bore, each of the one or more rear radius-reducing members having the preselected thickness, wherein the rear radius-reducing member is configured to reduce a diameter dimension of the rear cylindrical bore.

* * * * *